US010316593B2

(12) United States Patent
Pike

(10) Patent No.: US 10,316,593 B2
(45) **Date of Patent: *Jun. 11, 2019**

(54) DOWNHOLE TOOL COUPLING AND METHOD OF ITS USE

(71) Applicant: Reeves Wireline Technologies Limited, Leicestershire (GB)

(72) Inventor: James Arthur Pike, Nottingham (GB)

(73) Assignee: Reeves Wireline Technologies Limited, Leicestershire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/355,247

(22) Filed: Nov. 18, 2016

(65) Prior Publication Data

US 2017/0191321 A1 Jul. 6, 2017

Related U.S. Application Data

(63) Continuation of application No. 13/905,257, filed on May 30, 2013, now Pat. No. 9,512,697.

(30) Foreign Application Priority Data

Jun. 1, 2012 (GB) ..... 1209805.9

(51) Int. Cl.
*E21B 17/02* (2006.01)
*E21B 41/00* (2006.01)
*E21B 47/12* (2012.01)

(52) U.S. Cl.
CPC ..... *E21B 17/028* (2013.01); *E21B 17/023* (2013.01); *E21B 41/00* (2013.01); *E21B 47/122* (2013.01)

(58) Field of Classification Search
CPC ..... E21B 17/028; E21B 17/023; E21B 47/00; E21B 43/14; E21B 43/08; E21B 43/00;
(Continued)

(56) References Cited

U.S. PATENT DOCUMENTS 4,901,069 A 2/1990 Veneruso
5,706,892 A 1/1998 Aeschbacher
(Continued)

FOREIGN PATENT DOCUMENTS

GB 2439426 A 12/2007

OTHER PUBLICATIONS

Search Report from corresponding UK Appl. GB1209805.9, dated Aug. 22, 2012.

*Primary Examiner* — Yong-Suk Ro
(74) *Attorney, Agent, or Firm* — Blank Rome LLP

(57) ABSTRACT

A downhole tool coupling (10) comprises first (11) and second (12) downhole tool elements that are securable one to the other in a releasably locking manner by moving the tool elements from a longitudinally relatively less proximate, especially overlapping position into longitudinally relatively more overlap with one another. The first downhole tool element (11) supports a first inductive, capacitative and/or magnetic energy coupler (23) and the second downhole tool element (12) supports a second inductive, capacitative and/or magnetic energy coupler (24). The first and second energy couplers (23, 24) are moveable from an energetically uncoupled position when the tool elements (11, 12) are in the longitudinally relatively less overlapping position to an energetically coupled position when the first and second downhole tool elements (11, 12) overlap relatively more.

4 Claims, 4 Drawing Sheets

(58) Field of Classification Search
CPC ... E21B 41/00; H02J 7/00; H02P 9/04; H04H 1/10
See application file for complete search history.

(56) References Cited

U.S. PATENT DOCUMENTS

| | | | | |
|---|---|---|---|---|
| 6,360,820 | B1 | 3/2002 | Laborde | |
| 6,670,880 | B1 | 12/2003 | Hall | |
| 6,844,498 | B2 | 1/2005 | Hall | |
| 9,512,697 | B2 * | 12/2016 | Pike | E21B 41/00 |
| 2001/0042617 | A1 | 11/2001 | Beck | |
| 2002/0193004 | A1 | 12/2002 | Boyle | |
| 2005/0070143 | A1 | 3/2005 | Eriksson | |
| 2005/0087368 | A1 | 4/2005 | Boyle | |
| 2006/0260797 | A1 | 11/2006 | Hall | |
| 2006/0260798 | A1 | 11/2006 | Hall | |
| 2007/0295504 | A1 | 12/2007 | Patel | |
| 2008/0012569 | A1 | 1/2008 | Hall | |
| 2008/0106433 | A1 | 5/2008 | Madhavan | |
| 2008/0251247 | A1 | 10/2008 | Flint | |
| 2009/0066535 | A1 | 3/2009 | Patel | |
| 2010/0101786 | A1 | 4/2010 | Lovell | |
| 2010/0182012 | A1 | 7/2010 | Harmon | |
| 2011/0057810 | A1 | 3/2011 | Partouche | |
| 2013/0186641 | A1 | 7/2013 | Lovell | |

* cited by examiner

DOWNHOLE TOOL COUPLING AND METHOD OF ITS USE

CROSS-REFERENCE TO RELATED APPLICATIONS

This application is a continuation of U.S. application Ser. No. 13/905,257, filed 30 May 2013, which claims the benefit under 35 U.S.C. § 119(a) to U.K. Appl. No. GB 1209805.9, filed 1 Jun. 2012, both of which are incorporated herein in their entirety by reference.

FIELD OF THE DISCLOSURE

The invention relates to a downhole tool coupling, in particular of a kind that is suitable for coupling elements of logging toolstrings in downhole locations.

BACKGROUND OF THE DISCLOSURE

As is well known, prospecting for minerals of commercial or other value (including but not limited to hydrocarbons in liquid or gaseous form; water e.g. in aquifers; and various solids used e.g. as fuels, ores or in manufacturing) is economically an extremely important activity. For various reasons those wishing to extract such minerals from below the surface of the ground or the floor of an ocean need to acquire as much information as possible about both the potential commercial worth of the minerals in a geological formation and also any difficulties that may arise in the extraction of the minerals to surface locations at which they may be used.

For this reason over many decades techniques of logging of subterranean formations have developed for the purpose of establishing, with as much accuracy as possible, information as outlined above both before mineral extraction activities commence and also, increasingly frequently, while they are taking place.

Broadly stated, logging involves inserting a logging tool including a section sometimes called a "sonde" into a borehole or other feature penetrating a formation under investigation; and using the sonde to energise the material of the rock, etc, surrounding the borehole in some way. The sonde or another tool associated with it that is capable of detecting energy is intended then to receive emitted energy that has passed through the various components in the rock before being recorded by the logging tool.

Such passage of the energy alters its character. Knowledge of the attributes of the emitted energy and that detected after passage through the rock may reveal considerable information about the chemistry, concentration, quantity and a host of other characteristics of minerals in the vicinity of the borehole, as well as geological aspects that influence the ease with which the target mineral material may be extracted to a surface location.

The boreholes used for the purpose explained above may extend for several thousands or tens of thousands of feet from a surface location. This makes it hard to communicate with a logging tool that is conveyed a significant distance along the borehole.

It is known to provide logging tools that are essentially autonomous in use. Such tools may include energy sources such as electrical batteries, together with one or more on-board memory devices.

An autonomous tool of this kind may be conveyed e.g. by inserting it supported on drillpipe, or pumping using any of a variety of fluids, to a great depth in a borehole where it may perform logging activities as outlined above. Since the tool is self-powered it may carry out logging operations following deployment, and may record log data using the on-board memory.

The tool is recovered to a surface location at the completion of logging activity. At this point the log data may be downloaded from the memory, processed, analysed and/or displayed in a variety of ways that will be known to the worker of skill in the art.

An autonomous logging tool, however, is not normally capable of signalling correct deployment at its downhole location; nor is it usually capable of sending log data to a surface location in real-time; nor may it normally receive complex control commands from a surface location. Of particular significance in some situations is the fact that the data cannot be accessed until the tool is retrieved completely to a surface location.

Some techniques for signalling between autonomous tools in downhole locations and surface equipment are known. These generally involve the generation of coded pulses in the fluids (that may be "muds" of a kind familiar to those of skill in the art, or other fluids) that fill the borehole and that are used inter alia for pumping tools between surface and downhole locations.

These mud pulses, however, amount to very narrow bandwidth, low bit-rate communications that are not at all suitable for conveying log data in real-time. Moreover the mud pulses require energy to generate and can be ambiguous due to their propagation over many thousands of feet of the borehole depth. Mud pulse signalling therefore is often of little help in the controlling of logging tools and the rapid acquisition of data.

One known logging technique, sometimes referred to as "logging while drilling" (LWD), involves logging a hydrocarbon reservoir while drilling it to create a producible hydrocarbon well. LWD requires the incorporation of an operative logging tool in a mineral drill, or at any rate the positioning of the logging tool in close proximity to the tool, and is an example of the general requirement in logging, indicated above, for log data to be acquired while extraction work is taking place. As drilling a borehole takes significant time, typically days, slow data rates although a disadvantage are useable in this application. Other logging techniques, to which the invention additionally pertains, would preferentially benefit from the rapid acquisition of log data. Examples of such techniques include memory logging with Wireline tools using techniques known as "drop-off", "pump down" and "Shuttle deployment."

It has for some decades been known to communicate with logging tools using so-called "wireline." A wireline, as is well known in the art, is an armoured cable that may be used for the purposes of supporting a logging tool while it is being withdrawn upwardly along a borehole or well during logging; transmitting, using electrical/electronic signals, data from the logging tool rapidly to a surface location; and transmitting control commands for the logging tool and in some cases power for powering the operations of the tool from the surface location.

Wireline logging techniques have proved extremely useful over many years. In particular wireline avoids many of the speed and bandwidth problems of slower communication techniques such as mud pulse signalling, thereby making wireline-supported logging tools more attractive than autonomous tools in various situations.

However, one difficulty associated with wireline logging tools is that it is not generally possible to maintain a connection during e.g. an LWD operation since the wireline presents an obstacle to jointing of the drill pipe at the surface. It therefore is often required to make and break electrical connections in downhole locations in order to permit the selective use of wireline and thereby avoid wireline fouling problems as would arise if the logging tool remained connected to the wireline during an LWD or other, similar operation.

This is also of particular importance during for example the deployment of a logging tool that is conveyed to a downhole location within or through drillpipe. Gathering data from the tool under such circumstances necessarily requires the movement of drill pipe. Such movement often creates a requirement for selective power and/or communications connection of the tool to and its disconnection from other components in the logging toolstring and/or to wireline.

The downhole environment is usually extremely harsh, partly because of significant fluid pressures that exist and also because various chemicals present in boreholes are not compatible with the use of electrical signals for data and power transmission. This could be because the chemicals are for example chemically aggressive and thereby degrade connector terminals, or because they are electrically conducting or insulating in ways that can interfere with the performance of electrical and electronic equipment exposed to them.

The damaging physical conditions in a downhole location make it extremely hard to design a reliable, releasable connector that meets the multiple requirements set out above.

Conventional plug-and-socket electrical connectors are available for use in downhole environments, for example in order to connect wireline to a logging toolstring. These connectors, however, require assembly at a surface location before being conveyed downhole in a borehole. Many such connection designs cannot be "made" after being "broken" in a downhole situation as may occur when the wireline is pulled away from the toolstring.

One type of connector that has been proposed as a solution to this difficulty is a so-called "wet connect" or "wet connector". This type of connector is intended for repeated making and breaking of electrical connections in remote environments in which there are fluids such as borehole fluids.

A typical wet connector is constituted by a pair of rigid jack-type connector elements a female one of which has an elongate, open-ended, circular-section cavity for receiving a cylindrical male connector. Electrical terminals formed in the interior of the female element and on the male element create an electrical connection when the male element is inserted correctly into the female.

Wet connectors, however, suffer from numerous problems one of which is that if any borehole fluid becomes interposed between the terminals respectively of the male and female elements, undesirable short circuits, open circuits and other anomalies, depending on the character of the borehole fluid, may arise.

Certain wet connector designs include features the aim of which is to minimise the chance of borehole fluid ingress in this way, but these features often are not successful. As a result for example, the anti-ingress features may make it less likely on mating of the male and female connector elements that the terminals will contact one another in a satisfactory manner.

Moreover, borehole fluids as indicated may be chemically aggressive, abrasive and/or under very high pressure. These factors tend to make the anti-ingress features of the wet connectors fail prematurely.

Yet another problem associated with wet connectors is that they tend to occupy a large volume in the vicinity of the toolstring parts requiring connection. This makes them unsuited for use in conjunction with mechanical latch arms of the kind that are often used for the temporary securing of parts of a toolstring, such as relatively uphole and downhole elements of a sonde assembly, together. This is particularly relevant when the maximum tool diameter is a constraint, i.e. when passing through 3.5" drillpipe that is common in the industry.

Thus, there is a need for a data and/or power transmitting arrangement that avoids or at least ameliorates one or more drawbacks, of the prior art, such as those indicated above. It would be particularly desirable to provide a coupling arrangement that is reliable in downhole LWD situations, as well as at other times, while being reuseable multiple times.

SUMMARY OF THE DISCLOSURE

According to the invention in a first broad aspect, there is provided a downhole tool coupling comprising first and second downhole tool elements that are securable one to the other in a releasably locking manner by moving the tool elements from a longitudinally relatively less proximate position into longitudinally relatively closer positioning relative to one another, the first downhole tool element supporting a first inductive, capacitative and/or magnetic energy coupler and the second downhole tool element supporting a second inductive, capacitative and/or magnetic energy coupler, the first and second energy couplers being moveable from an energetically uncoupled position when the tool elements are in the longitudinally relatively less proximate position to an energetically coupled position when the first and second downhole tool elements are closer to one another, wherein the first and second downhole tool elements are coupleable elements of a logging toolstring and wherein when the first and second energy couplers are energetically coupled the downhole tool coupling permits transmission of log data and/or control commands and/or landing data and/or electrical power.

Such a coupling has the strong advantage that through using mutually energetically couplable inductive, capacitative or magnetic couplers the requirement in for example a wet connector to employ terminals that must make a sound electrical or electronic connection is avoided entirely. This means that the various failure modes of wet connectors as described above do not arise in use of the invention.

In particular, ingress of borehole fluid into the vicinity of the coupling of the invention is unlikely to be a problem. Therefore there is no need to take steps to avoid or prevent such ingress; and in turn this means that the parts of the coupling may be made easier to connect together reliably in a downhole location.

Moreover, because there is no contact between the couplers, they can be fluidically sealed inside the tool elements to which they pertain. This means that any adverse corrosive and/or abrasive effects of borehole fluid can be accommodated by fluidically isolating the couplers away from the fluid. This may be achieved using robustly engineered shielding and/or containment parts; and the coupling may be made in the main from rigid, strong materials such as various steels that are known to be suitable oil and gas or mining industry use. This has the advantage that the coupling as a whole may be manufactured to be long-lasting in downhole environments.

In one preferred embodiment of the invention in the relatively less proximate position, the first and second downhole tool elements longitudinally overlap one another less than when the first and second downhole tool elements relatively are closer to one another.

In another embodiment of the invention in the relatively less proximate position, the first and second downhole tool elements are longitudinally non-overlapping and move into longitudinally overlapping relation when they are relatively closer to one another.

In yet another embodiment of the invention in the relatively less proximate position, the first and second downhole tool elements are longitudinally non-overlapping and when they are relatively closer to one another they are also longitudinally non-overlapping while being energetically coupled one to the other.

Regardless of the precise constructional mode adopted, preferably the first and second downhole tool elements each respectively include one or more formations that are mutually releasably interengageable in order releasably lockingly to secure the first and second tool elements one to the other.

The tool elements, therefore, may be manufactured including locking parts that are capable of strongly securing the parts together. Examples of mutually interengageable locking parts that are suitable, include, but are not limited to, spring-biased arm and catch combinations (sometimes called "latching arms") that are known in the downhole toolstring art.

In preferred embodiments of the invention, the first downhole tool element includes formed therein a hollow recess that terminates in an opening on a surface of the first downhole tool element; and the second downhole tool element includes a protuberance that is insertable in the hollow recess, the extent of insertion of the protuberance in the hollow recess depending on the amount of relative overlap between the first and second downhole tool elements.

The elements of the coupling of the invention may be such that the elements have no degree of overlap when in the relatively less overlapping condition; or they may have a certain degree of initial overlap that increases when the parts adopt the indicated position of more overlap. Thus, the tool elements may be completely separated from one another when the coupling is disconnected; or they may be partially overlapping when in an unconnected state. Both designs are within the scope of the invention as claimed.

Conveniently, the formations releasably lockingly engage one another when the protuberance is inserted in the hollow recess such that the first and second downhole tool elements overlap relatively more, to a maximal extent corresponding to landing of the first and second downhole tool elements one on the other.

The releasable latching arrangement for securing the tool elements together may in other words advantageously be arranged to secure the elements together when they are correctly landed, and when the degree of overlap is the maximum possible. This helps to assure a good coupling of energy between the first and second couplers.

In preferred embodiments of the invention, the first and second energy couplers longitudinally overlap at least partially when the first and second downhole tool elements overlap relatively more.

Moreover, it is preferable that the first energy coupler is or includes an annulus that, when the first and second energy couplers longitudinally overlap at least partially, surrounds the second energy coupler over at least part of its length.

The foregoing features advantageously suit the coupling of the invention to being formed including inductive energy couplers, and more specifically coils that when overlapping operate in an energy-transferring manner without requiring physical contact between the couplers.

However, as explained herein in other embodiments of the invention, other arrangements are possible in which annular constructions of the couplers are not required and/or in which overlap is not required in order for energy transfer to take place.

In embodiments of the invention in which overlap of the energy couplers occurs in order to affect energy transfer, optionally when the first and second energy couplers longitudinally overlap at least partially the first energy coupler overlaps the second energy coupler over at least 50% of the length of the second energy coupler. In another arrangement within the scope of the invention optionally the second energy coupler may overlap the first energy coupler over at least 50% of the length of the first energy coupler. The foregoing does not exclude arrangements in which the two energy couplers overlap each other by 50% of their respective lengths.

Regardless of the precise extent of any overlap of the energy couplers, preferably the second energy coupler is insertable into the annulus of the first energy coupler, when the latter is as indicated formed as or including an annulus.

Conveniently, one or more shields surround the first and/or the second energy coupler so as to prevent contact between the energy couplers on insertion of the second energy coupler into the annulus of the first energy coupler.

The use of such shields means that the energy couplers can be completely proofed against ingress of e.g. borehole fluid or other contaminants that give rise to the drawbacks of wet connectors.

Moreover, the energy couplers can, by reason of not requiring mutual contact in order to transfer energy, be to some extent armoured thereby further improving the ability of the coupling of the invention to survive harsh downhole environments. The shields thus also prevent the parts of the coupling from suffering impact damage during deployment and/or during handling/transport at a surface location.

As an alternative to arrangements in which the energy couplers overlap in order to couple energy, optionally the apparatus of the invention may include one or more auxiliary energy couplers that create an energy coupling between non-overlapping said first and second energy couplers when the first and second tool elements overlap more.

In such an embodiment of the invention and as summarised above, it is not necessary for the energy couplers themselves to overlap in order to transfer energy in the form of data, commands and/or power.

The first and second energy couplers in such an embodiment preferably are magnetic couplers and the one or more auxiliary energy couplers includes a conductor of magnetic energy. Thus the energy coupling arrangement of the invention may be configured as a magnetic circuit the fundamental nature of which will be known to engineers and physicists.

Other couplings are also envisaged within the scope of the invention that allow the transmission of power and/or data. An example is optical coupling.

In other arrangements within the scope of the invention, however, the one or more auxiliary energy couplers is or includes another rigid structure that instead of being magnetically conducting may be electrically conducting. One example of such a structure is an elongate section of the casing of a tool or element forming the logging toolstring. In other words the electrically conducting nature of the metals from which such casings are made could in embodiments of the invention advantageously be used for the purpose of coupling data and even power transmission between the first and second tool elements when they are longitudinally relatively closer to one another.

In yet further arrangements of the inventive concept, the one or more auxiliary energy couplers do not need to be a rigid item. A range of flexible auxiliary couplers may be contemplated, including for instance borehole fluid. This could be rendered electrically and/or magnetically conducting for example by ensuring that it contains a sufficient density of conducting particles. Such particles could include conducting metal filings or a range of other materials including mixtures of materials that achieve desired characteristics in the borehole fluid.

Regardless of whether any auxiliary energy couplers are present, in preferred embodiments of the invention the first and second energy couplers are each selected from the group comprising an electrical inductor, a capacitor or a magnetic inductor, the first and second energy couplers being such as to couple energy when the first and second tool elements adopt the position of longitudinal relative closeness as described.

In a particularly preferred embodiment of the invention, at least the first energy coupler, and preferably both the first and second energy couplers, is/are configured as one or more induction coils. To this end conveniently the second energy coupler is or includes a hollow cylinder, in addition to the first energy coupler being a hollow cylinder as stated.

In a practical arrangement in accordance with the invention, the first downhole tool element is or includes a latching sub of a sonde. Such a latching sub may conveniently be operatively connected at the downhole end of a length of wireline intended to extend in use along a borehole. Conveniently in such a case, the first energy coupler is or includes an annulus that lines part of the hollow interior of the latching sub.

The second downhole tool element may be or include a further downhole component terminating at its in-use uphole end in a fishing neck. In such an embodiment of the invention the second energy coupler may be or include an annulus that encircles part of the fishing neck. In use of the coupler of the invention, the fishing neck may be inserted into (or further inserted into, if there is as postulated herein initial overlap of the coupling parts) the hollow interior of the latching sub as part of a process of causing overlap, or increased overlap, of the parts of the coupling.

As noted, the first energy coupler advantageously may be operatively connected to wireline, to a data recording sonde and/or to a data recording memory device. Additionally or alternatively, the second energy coupler may be operatively connected to a data recording sonde and/or to a data recording memory device.

In a second aspect, the invention is or includes a method of coupling tools in a downhole location comprising securing first and second downhole tool elements of a downhole tool coupling according to any preceding claim one to the other in a releasably locking manner by moving the tool elements from a longitudinally relatively less proximate position into longitudinally relatively closer positioning one relative to the other, thereby energetically coupling the first and second energy couplers in a data, power and/or command transferring manner as the first and second downhole tool elements become closer to one another.

Preferably, the method further includes one or more of:

a. transmitting log data between the first and second tool elements;
b. transmitting one or more control commands between the first and second tool elements;
c. transmitting landing data from the second to the first tool element;
d. transmitting electrical power from the first to the second downhole tool element.

BRIEF DESCRIPTION OF THE DRAWINGS

There now follows a description of preferred embodiments of the invention, by way of non-limiting example, with reference being made to the accompanying drawings in which.

DETAILED DESCRIPTION OF THE DISCLOSURE

Figure 1:
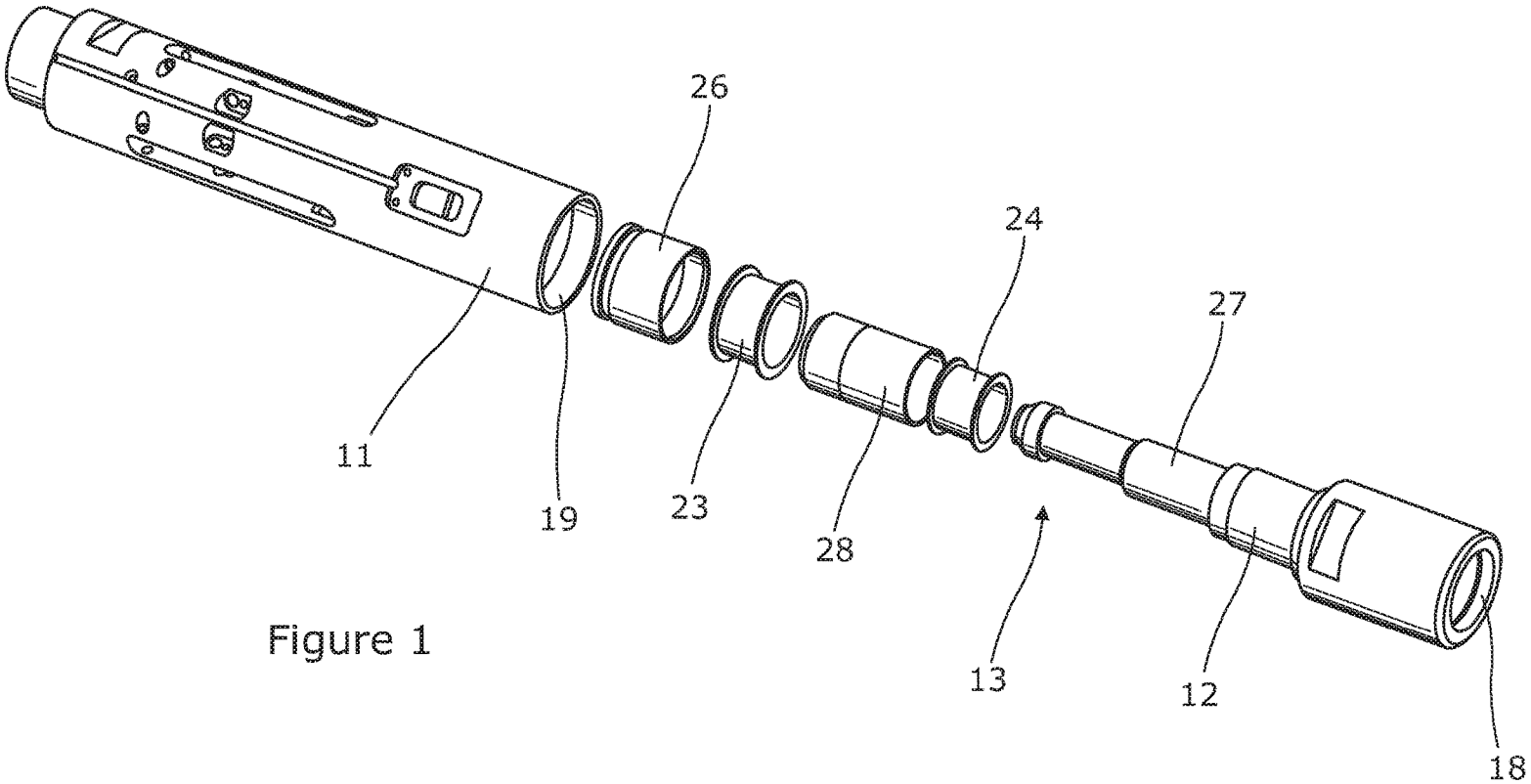
FIG. 1 is an exploded, perspective view of one form of downhole tool coupling according to the invention.

Referring to the drawings, a downhole tool coupling 10 comprises two principal components in the form of first and second tool elements 11, 12 that are intended for selective coupling together to form a connected toolstring; and releasing, in a downhole environment such as a subterranean borehole. The nature of the tool coupling of the invention is to provide reliable communications and/or power connection between the components 11, 12.

As is almost inevitably the case in respect of toolstring elements in a downhole environment, one 11 of the tool elements is located relatively uphole of the other, 12, that therefore may be regarded as existing in a relatively more downhole position.

In the embodiment illustrated, the relatively more uphole tool element 11 is constituted as a latching sub formed at the in use downhole end of an upper sonde section that may for example be a receiver of logging energy that has been passed through rock surrounding the borehole in which the toolstring is deployed.

The relatively more downhole tool element 12 is shown as a latching element having a so-called fishing neck 13 the design of which may take a variety of forms that are familiar to the worker of skill in the art. One typical characteristic of a fishing neck however is the presence of a cylindrical shank 14 that terminates at the in-use upper end of the fishing neck in an annular anchor 16 defining with the shank 14 a shoulder 17 that faces the downhole direction in use of the fishing neck 13.

Figure 2:
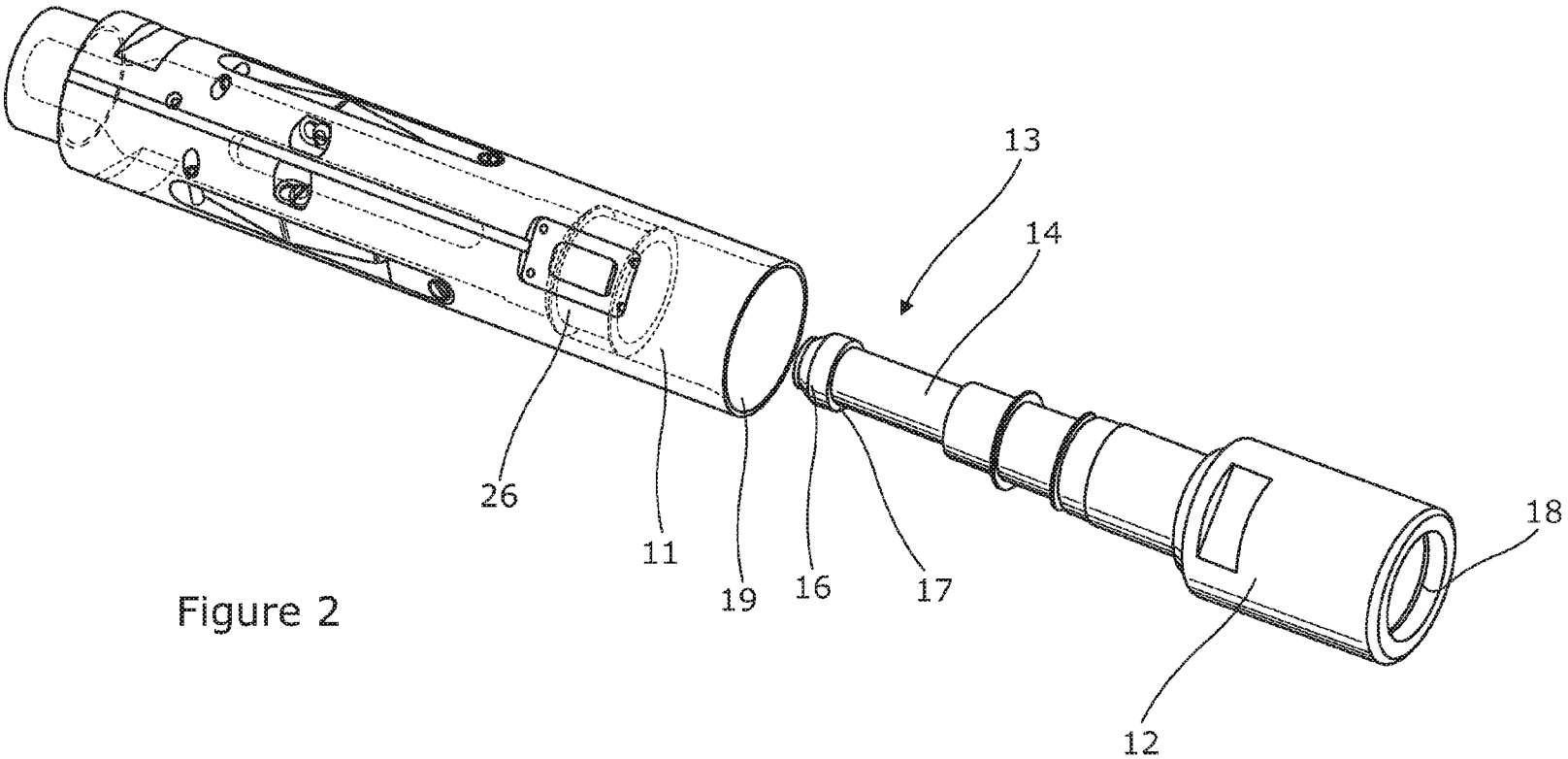
FIG. 2 shows the parts of the FIG. 1 coupling in a state of assembly prior to coupling of two principal parts of the coupling one to the other.
Figure 3:
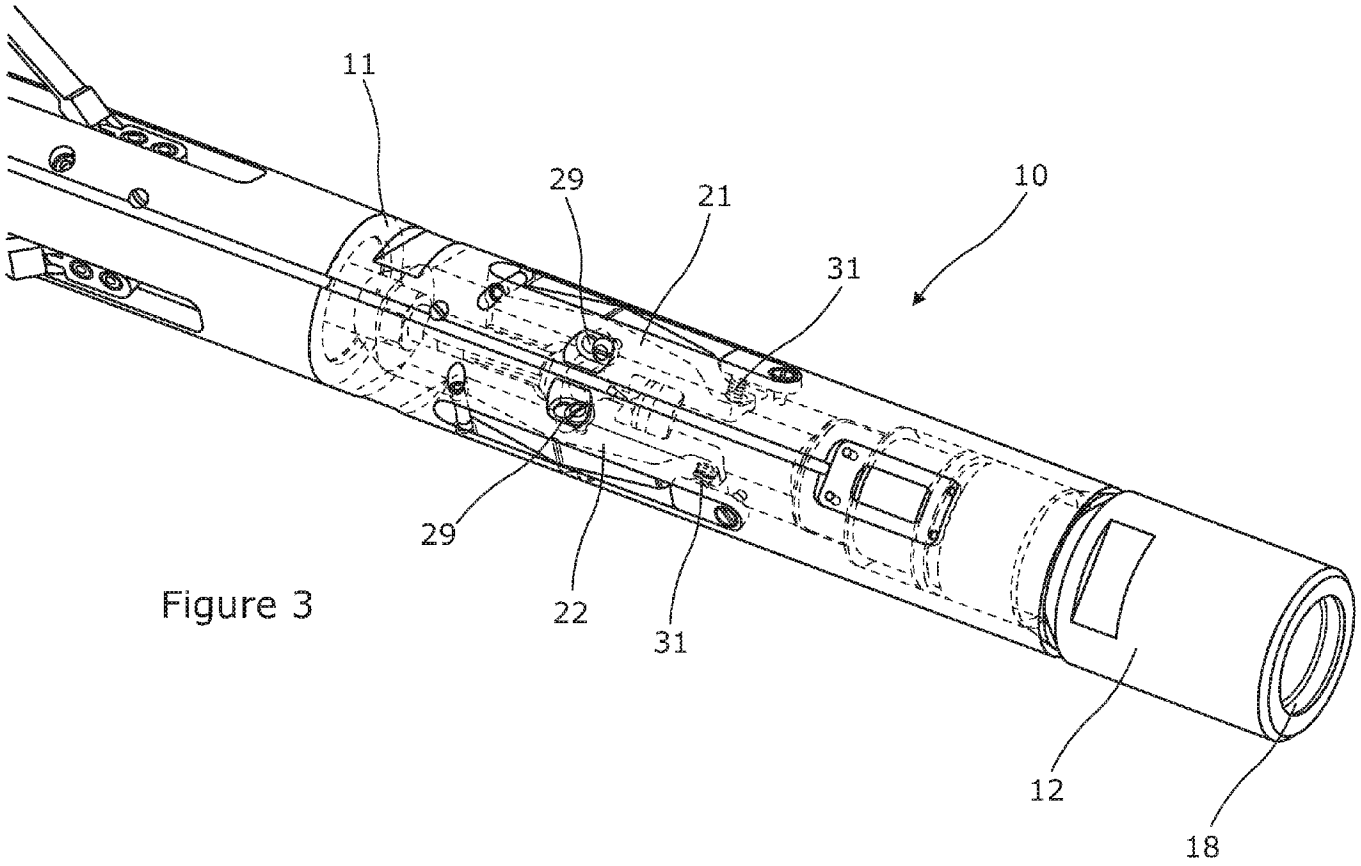
FIG. 3 shows the parts of FIGS. 1 and 2 partly in transparent shading in order to illustrate the coupled condition of the coupling.

The fishing neck 13, and in particular the shoulder 17, is engageable by latching arms 21, 22 as described below for the purpose of releasably locking the tool elements 11, 12 together. The latching arms 21, 22 amount to formations that are mutually releasably interengageable in order releasably lockingly to secure the first 11 and second 12 tool elements one to the other. The formations defined as the latching arms 21, 22 and the shoulder 17 respectively releasably lockingly engage one another when the protuberance constituted by fishing neck 13 is inserted in the hollow interior of first tool element 11 such that the first and second downhole tool elements 11, 12 move into relatively closer proximity in the longitudinal direction compared to the position shown in FIG. 2, to a maximal extent corresponding to landing of the first and second downhole tool elements 11, 12 one on the other.

The downhole tool element 12 may at its downhole end be connected to any of a wide range of tools or other components. As an example, an energy-emitting sonde (omitted from the drawings for ease of illustration) may be connected at the hollow downhole socket end 18 of tool element 12 that is visible in the figures.

The relatively uphole tool element 11 as shown over part of its length is formed as an elongate, hollow cylinder that is open at its in use downhole end 19. The first tool element 11 in this way includes a hollow recess that terminates in an opening (at end 19, as illustrated) on a surface of the first downhole tool element. The second downhole tool element 12 includes a protuberance in the form of fishing neck 13 that is insertable in the hollow recess.

The uphole tool element 11 is hollow over a sufficient part of the length of the element 11 as to permit insertion of the fishing neck 13 inside it.

The latching arms 21, 22 are positioned inside the tool element 11 so as to be releasably engageable with the in-use downhole side of shoulder 17.

In order to position the tool element 12 for latching inside the tool element 11, it is necessary for the two tool elements 11, 12 to move longitudinally from a position of relative proximity (that in the embodiment illustrated is a position of initial overlap referred to herein as "less overlap") to a position of relative closeness (referred to in relation to the illustrated embodiment as "more overlap").

This occurs through a process of insertion of the fishing neck 13 via open downhole end 19. This process of insertion may commence with the tool elements 11, 12 partially overlapping (i.e. so that the fishing neck 13 is initially inserted a certain distance into end 19) or with the tool elements spaced longitudinally from one another.

In the latter case, it is necessary during such insertion to ensure that the tool elements 11, 12 are correctly aligned to ensure accurate coupling together. This may be achieved through appropriate tapered shaping of the annular anchor 16, as illustrated.

When the second tool element 12 is initially partially inserted into the interior of element 11, such guidance is less critical to successful operation of the coupling 10.

A first energy coupler 23 is formed as a cylindrical annulus lining the interior of first tool element 11. The diameter of the annulus of first energy coupler 23 is sufficiently large as to permit sliding insertion therethrough of the fishing neck 13 including supported thereon a second energy coupler 24.

The annulus of first energy coupler 23 typically has an outer diameter that is slightly less than the diameter of the interior of first tool element 11. A shield member in the form of a rigid cylindrical sleeve 26 is interposed between the first energy coupler 23 and the interior wall of the first tool element 11. The sleeve 26, which is made from a rigid, corrosion-resistant metal alloy, protects the first energy coupler against the kinds of damage that can arise in downhole environments.

Second energy coupler 24 is also formed as an annulus. It is formed so as to encircle a further shank 27 of second tool element 12. Further shank 27 is a bar of similar design to shank 14, to which it is connected and in practice formed integrally as illustrated in the drawings. Further, shank 27 is of larger diameter than shank 14, but nonetheless is sufficiently small as to fit slidingly inside first tool element 11. The diameter of second energy coupler 24 is also sufficiently small as to let the combination of the downhole tool element 12 and the energy coupler 24 fit inside the first tool element 11.

A second shield member that also in the embodiment shown is an elongate, rigid, corrosion-resistant hollow sleeve 28, overlies second energy coupler 24 between the outer diameter of energy coupler 24 and the inner diameter of energy coupler 23. Second sleeve 28 serves a similar purpose to sleeve 26.

The energy couplers 23, 24 may as indicated herein be formed as inductive, capacitative and/or magnetic energy couplers. Thus they may be formed as coils, capacitor plates or magnetically conducting elements, depending on the precise design of the coupler 10 of the invention.

Notwithstanding the exact choice of energy couplers 23, 24, it is possible through careful design of the parts of the coupler 10 to arrange that in the position of relatively less overlap of the first and second tool elements 11, 12 there is no energy coupling between the energy couplers; and when they adopt a configuration of relatively more overlap energy coupling, inductively, capacitatively, or magnetically may occur.

Such energy coupling is more than adequate to provide the high bitrate communications needed between e.g. an autonomous logging tool attached to downhole socket end 18 and a wireline connected in the uphole, first tool element 11. To this end, the first energy coupler 23 is in preferred embodiments of the invention electrically (i.e. data transmittingly) coupled to a wireline that may be of conventional design, or to electronically active parts of the uphole sonde referred to above.

The second energy coupler 24 typically in preferred embodiments of the invention is coupled to the downhole sonde mentioned herein that is supported on the downhole tool element 12 by way of fishing neck 13. It follows that when the first and second tool elements 11, 12 are landed one in the other and latched data and, as desired, power transmitting communication between them becomes possible by reason of the non-contacting overlap of the first and second energy couplers 23, 24.

Although in preferred embodiments of the invention the first and second energy couplers 23, 24 are non-overlapping when the first and second tool elements are in the relatively less overlapping configuration, it is possible for the energy couplers themselves to be initially overlapping to a limited extent and subsequently move to a more overlapping position corresponding to data and/or power communication between the energy couplers 23, 24.

The exact nature of the energy couplers will determine the extent of overlap (or, as appropriate, greater overlap) needed in order to establish reliable communication between the energy couplers. In preferred embodiments of the invention however overlap over 50% or more of the length of the first energy coupler (if this is the longer of the two couplers 23, 24) or overlap over 50% or more of the length of the second energy coupler occurs in the relatively more overlapping condition of the energy couplers 23, 24.

Figure 4:
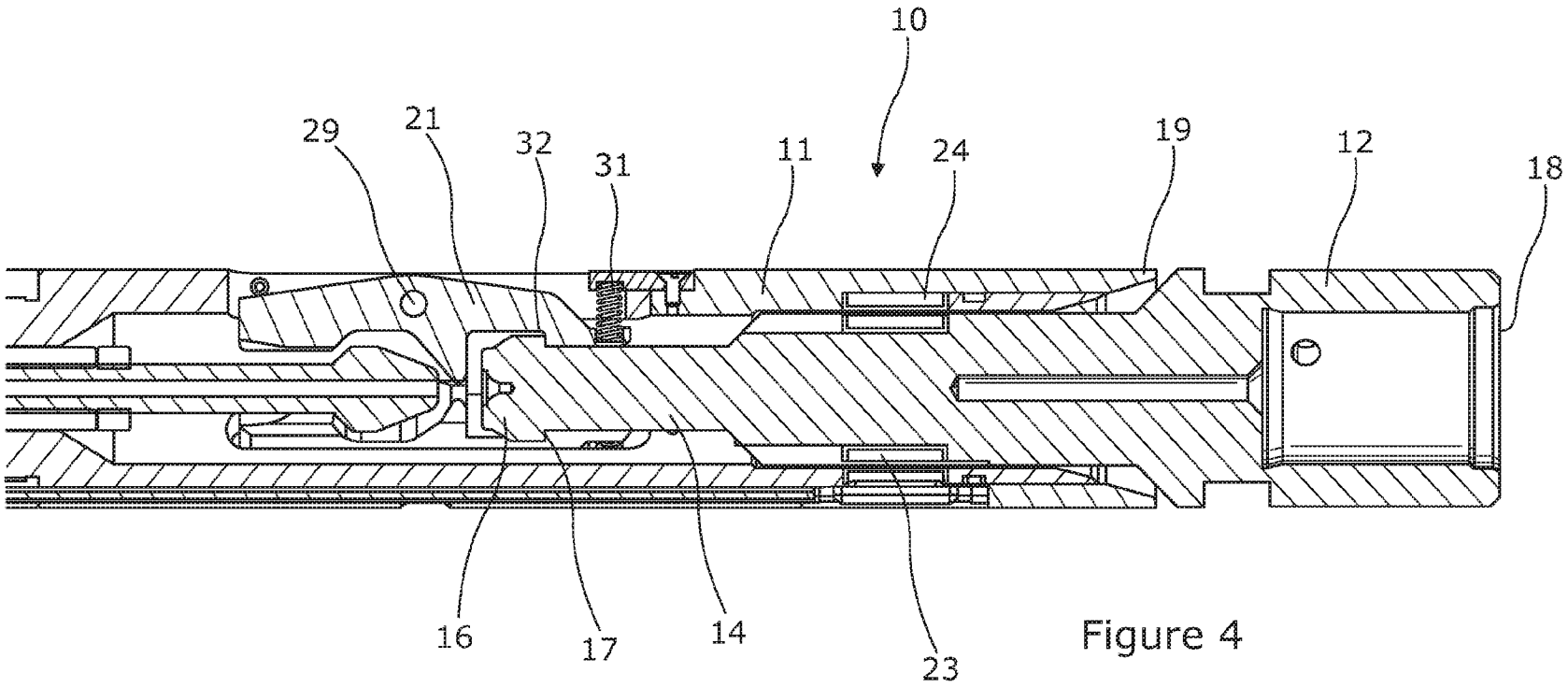
FIG. 4 is a longitudinally sectioned view showing the coupling in the condition visible in FIG. 3.

In a presently most preferred arrangement, the first and second energy couplers 23, 24 each occupy the same length along the coupling 10 and in the relatively more overlapping condition described overlap by up to 100% of their lengths. This condition is best illustrated in FIG. 4.

As mentioned above, however, it is not necessary for the first and second energy couplers to overlap at all, if it is possible to employ one or more auxiliary energy couplers in order to achieve an energy coupling effect on attainment of the relatively more overlapping condition of the tool elements 11, 12.

An example of when this may occur is when the first and second energy couplers 23, 24 are configured as elements of a magnetic circuit. In such a case, an auxiliary energy coupler in the form of e.g. a magnetically conducting bar or similar element may magnetically couple the first and second couplers when they are sufficiently proximate to correspond to landing of the tool elements 11, 12 together. The auxiliary coupler may be fixed for example inside the hollow interior of the first tool element 11 such that at one end it permanently overlaps at least part of the length of the first energy coupler 23. Movement of the first and second tool elements 11, 12 to their relatively more overlapped condition then could cause the other end of the magnetically conducting bar to overlap at least part of the length of the second energy coupler 24. In this way, the apparatus of the invention may provide for non-contact communication between the first and second tool elements 11, 12 even if there is no overlap possible between the first and second energy couplers 23, 24.

In another arrangement within the scope of the invention, the auxiliary energy coupler may be formed as an outer housing that encircles the described components in use. The wall of such a housing may be formed of or may include regions of electrically or magnetically conducting materials. Contact terminals may be provided that are engageable by the energy couplers or by further components electrically or magnetically coupled to them, thereby completing an electrical or magnetic circuit when the first and second elements 11, 12 move from a relatively less proximate to a relatively more proximate longitudinal position.

The latching arms 21, 22 are of essentially conventional design. Therefore, they are constituted as a pair of rockers that extend in the longitudinal direction of the coupling 10 and are pivotably mounted by way of pivot pins 29 at their approximate centres to the outer wall of uphole tool element 11.

At their downhole ends, the latching arms 21, 22 are biased radially inwardly by biasing springs 31. A short distance uphole of the springs 31 each arm 21, 22 is formed including an uphole facing shoulder 32. The radially inner sides of the latching arms 21, 22 and the anchor 16 of the fishing neck are shaped such that on insertion of the fishing neck 13 into the interior of first tool element 11 the anchor 16 forces the latching arms 21, 22 radially outwardly against the biasing provided by the springs 31. Once the anchor 16 has passed a predetermined distance along the latching arms 21, 22, the arms 21, 22 move radially inwardly under the influence of the springs 31 such that the shoulder 32 and the shoulder 17 engage one another in a form-locking manner.

Release of the latching arms 21, 22 may be affected by the application of pressure (generated in a number of ways that will be known in the art) at the uphole ends of the arms 21, 22. This causes cantilevering of the arms radially outwardly in order to provide clearance between the anchor 16 and the arms 21, 22. The fishing neck 13 and the uphole tool element then are separable from one another through relative movement of the parts of the coupling 10 longitudinally away from one another.

Other latching arrangements than the latching arms illustrated are possible within the scope of the invention.

Use of the illustrated coupling of the invention takes place as indicated in a downhole environment. In essence, the making of a connection using the coupling 10 involves moving the first and second tool elements 11, 12 into overlapping relation (or further into overlapping relation, if they are starting from a position of partial mutual overlap). This causes the energy couplers 23, 24 to become energetically coupled in one of the ways described above.

At the same time, the latching arms 21, 22 may activate when the anchor 16 is sufficiently far inserted into the interior of first tool element 11 as also described above. This causes latching of the parts of the coupling together when they are landed one relative to the other.

Such landing of the tools corresponds to initiation of at least data-transmitting, and in some embodiments also power-transmitting, communication between the first and second energy couplers 23, 24. This in turn may provide an initial data message affirming that successful landing has occurred before further communication takes place.

Release of the tool elements 11, 12 from one another may occur by firstly causing releasing of the latching arms 21, 22. This permits the tool elements 11, 12 to move apart from one another in the elongate direction of the borehole in which they operate. Such movement may be occasioned in a variety of ways, including, but not limited to, pulling in an uphole direction on wireline attached to the first tool element 11.

The coupling of the invention in an original fashion provides for data and/or power communication between two downhole elements that are required to be separable from one another, without any requirement for contact between electrically connecting socket parts. The disadvantages of the prior art as set out herein do not arise in the coupling of the invention.

The listing or discussion of an apparently prior-published document in this specification should not necessarily be taken as an acknowledgement that the document is part of the state of the art or is common general knowledge.

What is claimed is:

1. A downhole tool coupling, comprising:

first and second downhole tool elements that are securable one to the other in a releasably locking manner by moving the tool elements from a longitudinally relatively less proximate position into longitudinally closer positioning relative to one another, the first downhole tool element supporting a first energy coupler comprising one or more of an inductive, a capacitative, and a magnetic energy coupler, the second downhole tool element supporting a second energy coupler comprising one or more of an inductive, a capacitative, and a magnetic energy coupler, the first and second energy couplers being moveable from an energetically uncoupled position when the tool elements are in the longitudinally relatively less proximate position to an energetically coupled position when the first and second downhole tool elements are closer to one another, wherein the first and second downhole tool elements are coupleable elements of a logging toolstring, wherein when the first and second energy couplers are energetically coupled, the coupling of the first and second downhole tool elements permits transmission of one or more of log data, control command, landing data, and electrical power, and wherein the second downhole tool element is or includes a further downhole component terminating at an in-use uphole end of the further downhole component in a fishing neck.

2. The downhole tool coupling of claim 1, wherein the second energy coupler comprises an annulus that encircles part of the fishing neck.

3. A method of coupling tools in a downhole location, comprising:

securing first and second downhole tool elements of a downhole tool coupling one to the other in a releasably locking manner by moving the tool elements from a longitudinally relatively less proximate position into longitudinally relatively closer positioning one relative to the other, thereby energetically coupling first and second energy couplers in one or more of data, power, and command transferring manner as the first and second downhole tool elements become closer to one another, wherein the step of securing the first and second downhole tool elements one to the other includes inserting or further inserting a fishing neck of the second downhole tool element in the first downhole tool element.

4. The method of claim 3, wherein the second energy coupler comprises an annulus that encircles part of the fishing neck.

* * * * *